US006450870B2

(12) United States Patent
Ito

(10) Patent No.: US 6,450,870 B2
(45) **Date of Patent: *Sep. 17, 2002**

(54) VITRIFIED GRINDSTONE HAVING PORES PARTIALLY FILLED WITH RESIN, AND METHOD OF MANUFACTURING THE SAME

(75) Inventor: Kenji Ito, Kaizu-gun (JP)

(73) Assignee: Noritake Co., Limited, Nagoya (JP)

( * ) Notice: Subject to any disclaimer, the term of this patent is extended or adjusted under 35 U.S.C. 154(b) by 22 days.

This patent is subject to a terminal disclaimer.

(21) Appl. No.: 09/764,095

(22) Filed: Jan. 19, 2001

(30) Foreign Application Priority Data

Jan. 26, 2000 (JP) ..... 2000-017267

(51) Int. Cl.[7] ..... B23P 21/03

(52) U.S. Cl. ..... 451/542; 451/540; 451/541; 451/544; 451/546; 451/548; 51/295; 51/296; 51/297; 51/298; 51/307

(58) Field of Search ..... 451/540, 541, 451/542, 544, 546, 548; 51/295, 296, 297, 298, 307

(56) References Cited

U.S. PATENT DOCUMENTS

| | | | | | |
|---|---|---|---|---|---|
| 4,765,801 | A | * | 8/1988 | Masuda | 51/293 |
| 5,079,875 | A | * | 1/1992 | Unno et al. | 451/541 |
| 5,711,774 | A | * | 1/1998 | Sheldon | 51/307 |
| 6,093,225 | A | * | 7/2000 | Itoh | 51/295 |
| 6,319,019 | B1 | * | 11/2001 | Fuji | 451/541 |

FOREIGN PATENT DOCUMENTS

| | | |
|---|---|---|
| JP | 55-75461 | 1/1953 |
| JP | A-63-93567 | 4/1988 |
| JP | A-10-138149 | 5/1998 |
| JP | A-2000-135682 | 5/2000 |

* cited by examiner

*Primary Examiner*—M. Rachuba
*Assistant Examiner*—Shantese McDonald
(74) *Attorney, Agent, or Firm*—Oliff & Berridge, PLC

(57) ABSTRACT

A vitrified grindstone having a vitrified abrasive structure which has pores and which includes abrasive grains and an inorganic bonding agent that holds the abrasive grains together, wherein 10–95% of a total volume of the pores is filled with a cured resin. The vitrified abrasive structure may further include an aggregate such that the abrasive grains and the aggregate are held together by the inorganic bonding agent.

14 Claims, 2 Drawing Sheets

VITRIFIED GRINDSTONE HAVING PORES PARTIALLY FILLED WITH RESIN, AND METHOD OF MANUFACTURING THE SAME

BACKGROUND OF THE INVENTION

1. Field of the Invention

The present invention relates in general to a vitrified grindstone which has a vitrified abrasive structure impregnated with a cured resin, and a method of manufacturing such a vitrified grindstone.

2. Discussion of the Related Art

There is known a vitrified grindstone having a vitrified abrasive structure, in which abrasive grains and an optionally used aggregate are held together by a glassy inorganic vitrified bonding agent, and in which a multiplicity of pores or voids are formed between the abrasive grains. Owing to excellent properties of the vitrified grindstone, such as a relatively high degree of strength with which the bonding agent holds the abrasive grains together, and a relatively easy dressing operation, the vitrified grindstone is widely used for precision grinding operations. In recent years, there is a need for a vitrified grindstone capable of performing a grinding operation with improved efficiency, to meet a demand for shortening of the required grinding time.

On the other hand, there has been proposed for practical use a vitrified grindstone wherein the proportion or content of the inorganic bonding agent is made relatively high for increasing a grade of the vitrified grindstone and also a degree of strength with which the inorganic bonding agent holds the abrasive grains together. This vitrified grindstone has a relative high hardness, and can meet, to some extent, the above-indicated need for improving the grinding efficiency. However, this vitrified grindstone is not completely satisfactory. Namely, the use of the inorganic bonding agent in a relatively large proportion assures an increase in the strength of the vitrified grindstone, which contributes to an improvement in the grinding efficiency, but considerably reduces the porosity of the vitrified abrasive structure and results in difficult or insufficient fracturing and removal of the abrasive grains, leading to relatively easy glazing or clogging of the surface of the vitrified grindstone, relatively easy chipping of the abrasive structure, relatively difficult dressing operation of the vitrified grindstone, and other drawbacks encountered during use of the vitrified grindstone as a grinding tool. In addition, the use of the inorganic bonding agent in the relatively large proportion is likely to cause various drawbacks during the manufacture of the vitrified grindstone, such as cracking or deformation of the grindstone and insufficient removal or burn-out of the primary binder of the inorganic bonding agent, in the firing process. The insufficient removal of the binder may cause the manufactured vitrified grindstone to have some amount of residual carbon.

Such a vitrified grindstone with reduced porosity may be manufactured by hot-pressing of the materials of the grindstone, and may be used for performing a highly efficient grinding operation. However, this manner of manufacturing the vitrified grindstone requires special manufacturing equipment which usually suffers from low manufacturing efficiency, leading to a relatively high cost of manufacture of the vitrified grindstone, and a considerable limitation in the range of size of the vitrified grindstone that can be manufactured.

SUMMARY OF THE INVENTION

It is therefore a first object of the present invention to provide a vitrified grindstone which has a vitrified abrasive structure impregnated with a resin, and which is less likely to suffer from the above-indicated drawbacks relating to its use and manufacture and assures a high degree of grinding efficiency.

It is a second object of the present invention to provide a method of manufacturing such a vitrified grindstone.

The first object may be achieved according to a first aspect of this invention, which provides a vitrified grindstone having a vitrified abrasive structure which has pores and which includes abrasive grains and an inorganic bonding agent that holds the abrasive grains together, wherein 10–95% of a total volume of the pores is filled with a cured resin.

In the vitrified abrasive structure of the present vitrified grindstone, a suitable volumetric percentage of the total volume of the pores or voids is filled with the cured resin, so as to prevent filling of the pores with metal particles which are removed from the workpiece during a grinding operation using the present vitrified grindstone and which would otherwise be fused in the pores, causing clogging or glazing on the grinding surface of the vitrified grindstone. It is also noted that since the resin filling the pores is softer than the abrasive grains, the surface of the vitrified grindstone is comparatively recessed at local spots corresponding to the resin-filled pores, during the grinding operation on the workpiece, so that the abrasive grains adjacent to the surface of the abrasive structure gradually fracture or break down and are removed, making it possible to prevent an excessive rise of the temperature on the workpiece surface due to an excessive amount of heat of friction which would be generated between the workpiece surface and the abrasive grains that remain dull, and also prevent chipping of the vitrified grindstone while permitting easy dressing of the vitrified grindstone. The abrasive grains which are only loosely held together by the inorganic bonding agent can be tightly held together with an additional bonding force provided by the cured resin, so that the cured resin functions to avoid early removal of those abrasive grains, assuring a high grinding ratio.

It is further appreciated that the arrangement in which 10–95% of the total volume of the pores is filled with the cured resin is effective to prevent the hardness of the grindstone from being excessively hardened by the impregnation of the vitrified abrasive structure with the cured resin, while assuring a high grinding ratio. Since an excessive increase in the hardness of the vitrified grindstone is prevented, the present vitrified grindstone can be easily dressed as needed, making it possible to prevent a reduction in the service life of the vitrified grindstone. If the volumetric percentage of the pores that is filled with the cured resin is smaller than 10%, the effect of the impregnation of the abrasive structure with the cured resin cannot be expected. If the volumetric percentage of the pores that is filled with the cured resin is larger than 95%, the vitrified grindstone is excessively hardened, making it difficult to dress the vitrified grindstone.

It is to be understood that the vitrified abrasive structure of the vitrified grindstone may further include an aggregate such that the abrasive grains and the aggregate are held together by the inorganic bonding agent.

According to a first preferred form of the first aspect of the invention, 40–90% of the total volume of the pores is filled with the cured resin. In the vitrified grindstone of this first preferred form, an excessive increase in the hardness of the vitrified grindstone is more reliably prevented owing to the arrangement in which at least 10% of the total volume of the pores remains unfilled with the cured resin. Further, since at least 40% of the total volume of the pores is filled with the cured resin, it is possible to more reliably prevent the conventionally encountered drawbacks such as easy filling of the pores with metal particles, easy glazing or clogging of the surface of the vitrified grindstone, easy chipping of the abrasive structure, and easy removable of the abrasive grains. Thus, the present vitrified grindstone can be easily dressed without having to increase a load applied to the vitrified grindstone, leading to a further increased grinding ratio and providing a further improved surface smoothness of the workpiece.

According to a second preferred form of the first aspect of the invention, the cured resin consists of at least one thermosetting synthetic resin which is selected from a phenol resin and an epoxy resin, so that the vitrified grindstone has a higher degree of hardness than where the resin consists of a thermoplastic resin.

According to a third preferred form of the first aspect of the invention, the abrasive grains includes super abrasive grains (considerably fine abrasive grains) consisting of diamond abrasive grains, CBN abrasive grains, or mixture of diamond and CBN abrasive grains. The super abrasive grains preferably have Knoop hardness of at least 3000. It is preferable that the super abrasive grains have an average particle size of 20–220 $\mu$m. The particle sizes of 20 $\mu$m and 220 $\mu$m correspond to 800 and 60 meshes, respectively. Preferably, the super abrasive grains in the vitrified abrasive structure has a concentration of larger than 10 and smaller than 230, more preferably, a concentration ranging from 20 to 200.

According to a fourth preferred form of the first aspect of the invention, the vitrified abrasive structure has a porosity of 20–75% by volume, more preferably, 30–65% by volume, before the vitrified abrasive structure is impregnated with the resin.

According to a fifth preferred form of the first aspect of the invention, the inorganic bonding agent consists of a borosilicate glass or a crystallized glass which is suitable for holding super abrasive grains together. The crystallized glass may be, for example, a glass in which willemite precipitates. The inorganic bonding agent preferably has a thermal expansion coefficient ranging from $\alpha-(2\times10^{-6})$ to $\alpha+(2\times10^{-6})$ [1/K] (where $\alpha$ represents a thermal expansion coefficient of the super abrasive grains), so that the super abrasive grains can be tightly bonded together by the inorganic bonding agent.

According to a sixth preferred form of the first aspect of the invention, the vitrified abrasive structure includes 15–35% by volume of the inorganic bonding agent, so that the porosity of the vitrified abrasive structure is held in the volumetric range as described above, without deteriorating the holding strength with which the bonding agent holds the abrasive grains together. The vitrified abrasive structure may include, as an aggregate, a pore forming agent such as an inorganic balooning agent or other inorganic hollow substance.

The second object may be achieved according to a second aspect of this invention, which provides a method of manufacturing a vitrified grindstone having a vitrified abrasive structure which includes abrasive grains and an inorganic bonding agent that holds the abrasive grains together. This method comprises (a) a step of preparing a mixture of a liquid resin and a liquid diluent which is other than the liquid resin and which dilutes the liquid resin, such that the mixture includes 10–95% by volume of the liquid resin; (b) a step of impregnating the vitrified abrasive structure with the mixture; and (c) a step of curing the liquid resin contained in the mixture with which the vitrified abrasive structure is impregnated.

According to this method, the vitrified abrasive structure is impregnated with the mixture of the resin and the liquid diluent in the impregnating step, and the resin contained in the mixture is then cured or hardened in the curing step, for thereby making it possible to obtain the vitrified grindstone having the vitrified abrasive structure whose pores are partially filled with the cured resin, wherein a volume ratio of the cured resin to the pores is determined depending upon a kind of the liquid diluent and a mixing ratio of the liquid resin to the liquid diluent. Since the mixture includes 10–95% by volume of the liquid resin, 10–95% of a total volume of the pores is filled with a cured resin, as a result of the impregnation of the vitrified abrasive structure with the mixture. Thus, a suitable percentage of the total volume of the pores or voids of the vitrified abrasive structure is filled with the cured resin, so as to prevent filling of the pores with metal particles which are removed from the workpiece during a grinding operation using the present vitrified grindstone and which would otherwise be fused in the pores, causing clogging or glazing on the grinding surface of the vitrified grindstone.

It is also noted that since the resin filling the pores is softer than the abrasive grains, the surface of the vitrified grindstone is comparatively recessed at local spots corresponding to the resin-filled pores, during the grinding operation on the workpiece, so that the abrasive grains adjacent to the surface of the abrasive structure gradually fracture or break down and are removed, making it possible to prevent an excessive rise of the temperature on the workpiece surface due to an excessive amount of heat of friction which would be generated between the workpiece surface and the abrasive grains that remain dull, and also prevent chipping of the vitrified grindstone while permitting easy dressing of the vitrified grindstone. The abrasive grains which are only loosely held together by the inorganic bonding agent can be tightly held together with an additional bonding force provided by the cured resin, so that the cured resin functions to avoid early removal of those abrasive grains, assuring a high grinding ratio.

It is further appreciated that the present method merely requires, in addition to the steps performed in the conventional method of manufacturing the vitrified grindstone, the impregnating step and the curing step, and does not require conventionally used special equipment such as hot pressing equipment, which usually suffers from low manufacturing efficiency and a limitation in the range of size of the vitrified grindstone that can be manufactured. Still further, the volume ratio of the cured resin to the pores, which ratio is held in a range of 10–95%, is effective to prevent the hardness of the grindstone from being excessively hardened due to the impregnation of the vitrified abrasive structure with the cured resin, while assuring a high grinding ratio. Since an excessive increase in the hardness of the vitrified grindstone is prevented, the vitrified grindstone can be easily dressed as needed, making it possible to prevent a reduction in the service life of the vitrified grindstone. If the above-described volume ratio is smaller than 10%, the effect of the impregnation of the abrasive structure with the cured resin cannot be expected. If the volume ratio is larger than 95%, the vitrified grindstone is excessively hardened, making it difficult to dress the vitrified grindstone.

Since the hardness of the vitrified grindstone manufactured according to this method is determined depending upon the volumetric percentage of the pores filled with the cured resin, it is possible to manufacture vitrified grindstones having respective grades different from each other, by impregnating vitrified abrasive structures identical in grade with each other, with respective mixtures having different mixing ratios of the liquid resin to the liquid diluent. Further, since the pores of the vitrified abrasive structures are not fully filled with the resin, the hardness of the vitrified grindstone can be changed even after the manufacture of the grindstone has been completed, for example, by additionally impregnating the grindstone with a suitable amount of the liquid resin. It is accordingly unnecessary to manufacture, as end products, vitrified grindstones having different grades for respective different applications, and it is possible to suitably change the grade of each of vitrified grindstones which have been prepared in the same manner to have the same grade.

Preferably, the mixture prepared in the mixture preparing step includes 40–90% by volume of the liquid resin, so that 40–90% of the total volume of the pores is filled with the cured resin. Since at least 10% of the total volume of the pores remains unfilled with the cured resin, an excessive increase in the hardness of the vitrified grindstone is more reliably prevented. Since at least 40% of the total volume of the pores is filled with the cured resin, it is possible to more reliably prevent the conventionally encountered drawbacks such as easy filling of the pores with metal particles, easy glazing or clogging of the surface of the vitrified grindstone, easy chipping of the abrasive structure, and easy removable of the abrasive grains. Thus, the vitrified grindstone can be easily dressed without having to increase a load applied to the vitrified grindstone, leading to a further increased grinding ratio and providing a further improved surface smoothness of the workpiece.

Preferably, the liquid diluent is a volatile liquid, so that the liquid diluent contained in the mixture is rapidly volatilized before the curing of the resin in the curing step. The vitrified abrasive structure of the vitrified grindstone is effectively reinforced by the impregnation of the vitrified abrasive structure with the resin, since the resin is cured more efficiently than where the liquid diluent is volatized during the curing of the resin or after the curing of the resin.

More preferably, the liquid diluent is volatilized at a temperature of 40–100° C., so that the liquid diluent in the mixture is not substantially volatilized at a normal temperature, and is rapidly volatilized at a relatively low temperature in the curing step before the resin is cured. Since the liquid diluent is not substantially volatilized at a normal temperature, each step of the method is easily implemented.

BRIEF DESCRIPTION OF THE DRAWINGS

The above and other objects, features, advantages and technical and industrial significance of this invention will be better understood by reading the following detailed description of the presently preferred embodiment of the invention, when considered in connection with the accompanying drawings, in which.

DETAILED DESCRIPTION OF THE PREFERRED EMBODIMENT

Figure 1:
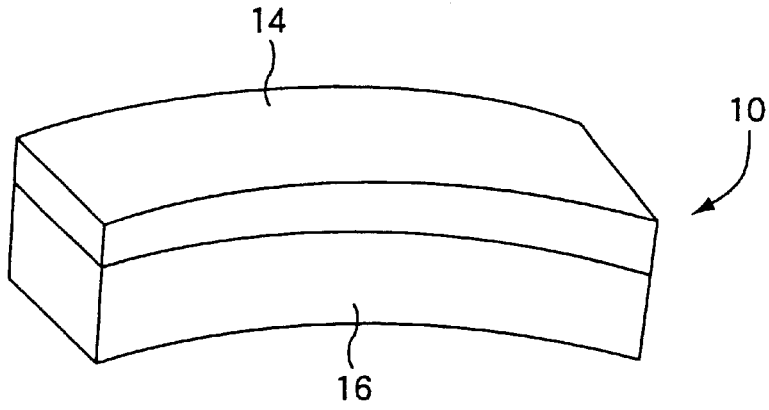
FIG. 1 is a perspective view showing an abrasive segment as a vitrified grindstone according to one embodiment of this invention, which grindstone has a vitrified abrasive structure reinforced by impregnation thereof with a resin.
Figure 2:
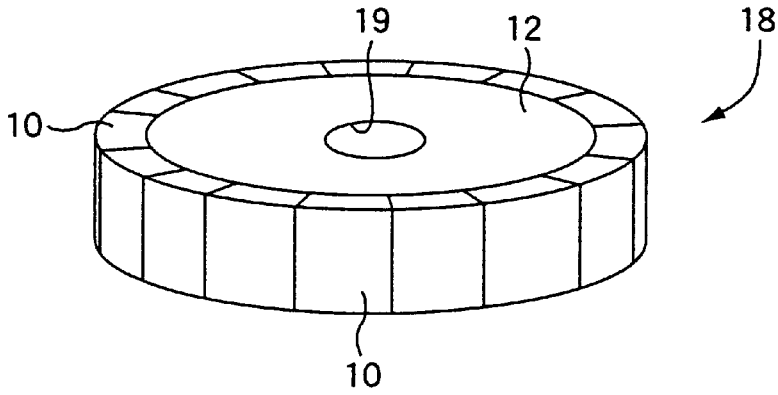
FIG. 2 is a perspective view of a grinding wheel whose radially outer portion consists of the abrasive segments of FIG. 1, which are arranged in the circumferential direction.

FIG. 1 shows an abrasive segment 10 as a vitrified grindstone constructed according to one embodiment of this invention, which grindstone has a vitrified abrasive structure reinforced by impregnation thereof with a resin. The abrasive segment 10 consists of a plate member which is curved so as to have a generally arcuate shape. FIG. 2 shows a grinding wheel 18 consisting of an inner core 12, and a circular array of abrasive segments 10 which are bonded to the outer circumferential surface of the inner core 12 with a suitable bonding adhesive such as an epoxy resin adhesive such that there does not exist any gap or clearance between the adjacent abrasive segments 10. The inner core 12 is formed of a metallic material, a fiber-reinforced synthetic resin or a vitrified grindstone. The inner core 12 has in its center a mounting through-hole 19, into which a rotary shaft of a grinding machine is to be fitted.

Each abrasive segment 10 consists of a radially outer layer 14 having an outer grinding surface, and a radially inner layer 16 which is formed integrally with the outer layer 14 and which functions as a base support layer for mechanically supporting the outer layer 14. Each of the outer and inner layers 14, 16 consists of abrasive grains and an inorganic bonding agent or a vitrified bond by which the abrasive grains are held together. Generally, the outer and inner layers 14, 16 use the same kind of inorganic bonding agent, but use different kinds of abrasive grains. For instance, the outer layer 14 includes super abrasive grains, such as cubic-crystal boron nitride (CBN) or diamond abrasive grains, which have a Knoop hardness value of at least 3000, while the inner layer 16 includes ordinary ceramic abrasive grains such as fused alumina grains, silicon carbide grains or mullite grains, which are relatively inexpensive. Preferably, the super abrasive grains used for the outer layer 14 have an average particle size within a range of 0.5–250 $\mu$m. The lower and upper limits of 0.5 $\mu$m and 250 $\mu$m respectively correspond to 32000 and 60 meshes.

Figure 3:
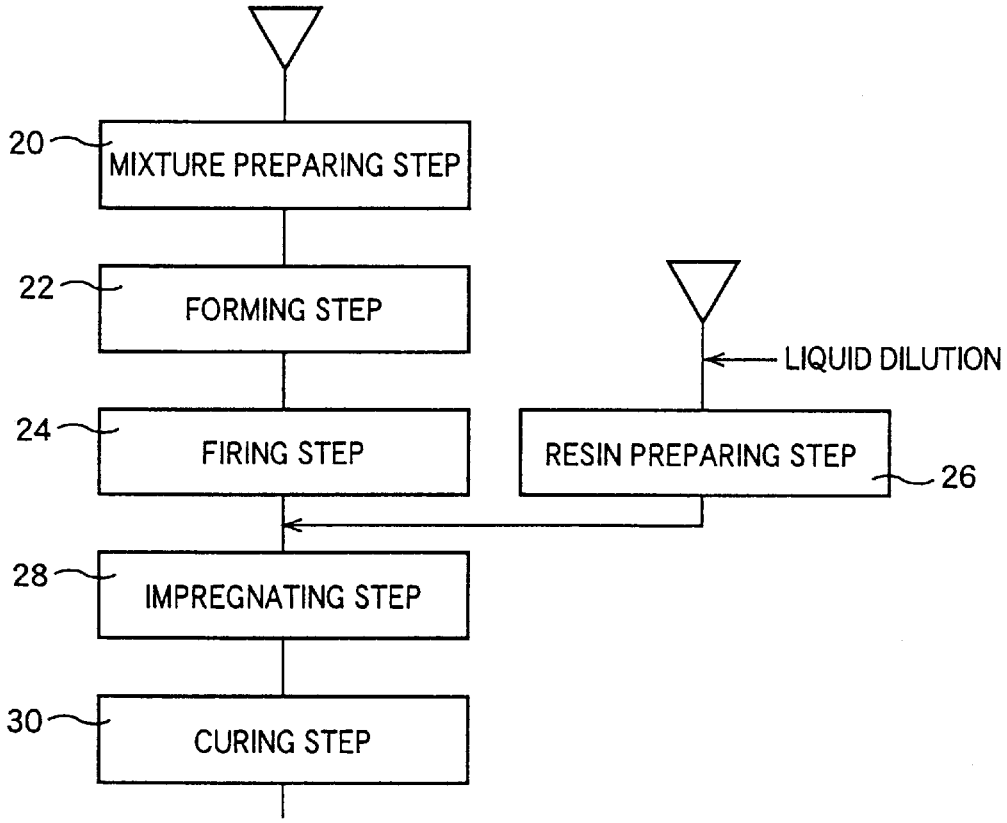
FIG. 3 is a view illustrating a process of manufacturing the abrasive segment of FIG. 1.

Each of the abrasive segments 10 used for the grinding wheel 18 may be manufactured by a method illustrated in the block diagram of FIG. 3. Initially, a mixture preparing step 20 is implemented to prepare mixtures or compositions for the radially outer and inner layers 14, 16 of the abrasive segment 10. Each of the mixtures for the outer and inner layers 14, 16 includes abrasive grains, a glassy inorganic bonding agent, a caking additive such as dextrin, and optionally suitable additives such as an organic substance and an inorganic balooning agent or other pore forming agent. Desired proportions of these materials are weighed and well mixed under stirring to prepare the mixture for each of the outer and inner layers 14, 16. In the present embodiment, the inorganic bonding agent consists of a borosilicate glass, or a crystallized glass in which willemite precipitates. The inorganic bonding agent preferably has a thermal expansion coefficient ranging from $\alpha-(2\times10^{-6})$ to $\alpha+(2\times10^{-6})$ [1/K] (where $\alpha$ represents a thermal expansion coefficient of the super abrasive grains), at a temperature ranging from a room temperature to 500° C. The proportion of the inorganic bonding agent is determined such that the fired vitrified abrasive structure of the abrasive segment 10 includes 15–35% by volume of the inorganic bonding agent. For example, the mixture for the outer layer 14 is prepared by mixing 18.0 parts by volume of a vitrified boding agent and 10.0 parts by volume of a caking additive into 50.0 parts by volume of CBN abrasive grains (type-I #80/#100 available form GE company), while the mixture for the inner layer 16 is prepared by mixing 18.0 parts by volume of a vitrified bonding agent and 10.0 parts by volume of a caking additive into 50.0 parts by volume of silicon carbide abrasive grains (#80).

The mixture preparing step 20 is followed by a forming step 22 in which the prepared mixtures for the outer and inner layers 14, 16 are introduced into a suitable metal mold whose cavity has a shape following the abrasive segment 10 to be manufactured. The mixtures in the mold are compressed or compacted by a press, to form an unfired or green precursor for the abrasive segment 10. Then, a firing step 24 is implemented to fire or burn the unfired precursor at a temperature of about 900° C., so as to obtain the fired abrasive segment 10 having, for example, a length of 40 mm, a width of 10.4 mm and a thickness of 7.4 mm. In this firing step 24, the caking additive included in the compositions is burnt out, while the inorganic bonding agent is fused to bond the abrasive grains together, so that the abrasive segment 10 has a porous vitrified abrasive structure having a network of continuous pores or voids, wherein the abrasive grains are held together by the inorganic bonding agent. In this vitrified abrasive structure, the abrasive grains have a concentration of 10–230, preferably, 20–200. The vitrified abrasive structure has a porosity of 20–75% by volume, preferably, 30–65% by volume.

In the meantime, a resin preparing step 26 is implemented to prepare a mixture by mixing a liquid phenol resin into a liquid diluent which is other than the liquid phenol resin and which does not impede curing of the resin. The liquid diluent preferably consists of a solvent, which is not easily volatilized at a normal temperature but is easily volatilized in a dried ambient when the resin is cured, and which has a relatively low boiling point, for example, about 200° C. or lower. In this respect, furfuryl alcohol having a boiling point of about 170° C. is preferably used as the liquid diluent to be mixed into the liquid phenol resin. 5–95 parts by volume of the furfuryl alcohol is mixed into predetermined parts by volume of the liquid phenol resin in the form of, for example, PR-9400 (available from Sumitomo Durez Company, Ltd), such that the sum of the volumes of the furfuryl alcohol and the liquid phenol resin corresponds to 100 parts by volume. The furfuryl alcohol and the liquid phenol resin are stirred for about three minutes, for thereby obtaining the mixture having a relatively low viscosity.

In the following impregnating step 28, the fired vitrified abrasive structure of the abrasive segment 10 which has the network of the multiple continuous pores is impregnated with the mixture obtained in the resin preparing step 26, so that the liquid phenol resin (thermosetting synthetic resin) and the liquid diluent (furfuryl alcohol) contained in the mixture are dispersed evenly into the entirety of the porous vitrified abrasive structure. This impregnating step 28 may be performed by: pouring the mixture in the fluid or liquid state in a suitable container made of stainless such that the mass of the fluid or liquid mixture in the container has a depth of about 10 mm; immersing the entirety of the abrasive segment 10 (which has been formed and fired in the forming and firing steps 22, 24) in the mass of the mixture; and evacuating the abrasive segment 10 so that the network of the continuous pores is filled with the mixture whose major component is the phenol resin. However, only a selected portion of the abrasive segment 10 may be immersed in the mass of the fluid or liquid mixture.

The impregnating step 28 is followed by a curing step 30 of holding the resin-impregnated abrasive segment 10 in a suitable drier, at a suitable temperature for a suitable length of time, for instance, at 18° C. for two hours. This curing step 30 may be implemented after the liquid mixture which sticks to the surface of the abrasive segment 10 without permeating into the abrasive segment 10, is removed by a suitable cloth. With implementation of the curing step 30, the phenol resin which is contained in the mixture filling the pores is cured, while the liquid diluent (furfuryl alcohol) contained in the mixture is rapidly volatilized as the temperature rises to a volatilization point of the furfuryl alcohol at the initial stage of the process of the curing of the resin. As a result of the volatilization or elimination of the furfuryl alcohol, only the cured phenol resin remains in the pores of the vitrified abrasive structure, so that the pores of the vitrified abrasive structure are partially filled with the cured phenol resin, wherein a volume ratio of the cured phenol resin to the pores is held in a range of 10–95% which corresponds to a volume ratio of the phenol resin to the mixture.

The abrasive segments 10, each of which is manufactured according to the method as described above, are bonded to the outer circumferential surface of the inner core 12 having an outside diameter of ϕ366 mm, with an epoxy resin adhesive, so that the grinding wheel 18 as shown in FIG. 2 is formed.

In the vitrified abrasive structure of each of the abrasive segments 10 of the grinding wheel 18, a suitable percentage of the total volume of the pores or voids is filled with the cured phenol resin, so as to prevent filling of the pores with metal particles which are removed from the workpiece during a grinding operation using the grinding wheel 18 and which would otherwise be fused in the pores, causing clogging or glazing on the grinding surface of each abrasive segment 10. It is also noted that since the phenol resin filling the pores is softer than the abrasive grains, the surface of the abrasive segment 10 is comparatively recessed at local spots corresponding to the resin-filled pores, during the grinding operation on the workpiece, so that the abrasive grains adjacent to the surface of the abrasive segment 10 gradually fracture or break down and are removed, making it possible to prevent an excessive rise of the temperature on the workpiece surface due to an excessive amount of heat of friction which would be generated between the workpiece surface and the abrasive grains that remain dull, and also prevent chipping of the abrasive segment 10 while permitting easy dressing of the vitrified grindstone. The abrasive grains which are only loosely held together by the inorganic bonding agent can be tightly held together with an additional bonding force provided by the cured resin, so that the cured resin functions to avoid early removal of those abrasive grains, assuring a high grinding ratio.

It is further appreciated that the above-described volume ratio of the cured phenol resin to the pores, which ratio is held in a range of 10–95%, is effective to prevent the hardness of the abrasive segment 10 from being excessively hardened by the impregnation of the vitrified abrasive structure with the cured resin, while assuring a high grinding ratio. Since an excessive increase in the hardness of the vitrified grindstone is prevented, the present vitrified grindstone can be easily dressed as needed, making it possible to prevent a reduction in the service life of the vitrified grindstone.

In the manufacture of the abrasive segment 10 according to the above-described method, the vitrified abrasive structure is impregnated with the mixture of the phenol resin and the furfuryl alcohol in the impregnating step 28, and the phenol resin contained in the mixture is then cured or hardened in the curing step 30, for thereby making it possible to obtain the resin-impregnated abrasive segment 10 having the vitrified abrasive structure whose pores are partially filled with the cured phenol resin, wherein the volume ratio of the cured phenol resin to the pores is determined depending upon the mixing ratio of the phenol resin to the furfuryl alcohol. Since the mixture includes 10–95% by volume of the phenol resin, the vitrified abrasive structure is impregnated with the mixture such that the volume ratio of the cured phenol resin to the pores is held in a range of 10–95%.

It is further appreciated that the above-described method merely requires, in addition to the steps performed in the conventional method of manufacturing the vitrified grindstone, the impregnating step 28 and the curing step 30, and does not require conventionally used special equipment such as hot pressing equipment, which usually suffers from low manufacturing efficiency and a limitation in the range of size of the abrasive segment that can be manufactured.

Since the hardness of the resin-impregnated abrasive segment 10 manufactured according to the above-described method is determined depending upon the volumetric percentage of the pores filled with the cured phenol resin, it is possible to manufacture abrasive segments 10 having respective grades different from each other, by impregnating vitrified abrasive structures which are obtained at the firing step 24 and which have respective grades identical with each other, with respective mixtures having different mixing ratios of the phenol resin to the furfuryl alcohol. In addition, since the pores of the vitrified abrasive structures are not fully filled with the resin, the hardness of the abrasive segment 10 can be changed even after the manufacture of the abrasive segment 10 has been completed, for example, by additionally impregnating the abrasive segment 10 with a suitable amount of the liquid resin. It is accordingly unnecessary to manufacture, as end products, abrasive segments 10 having different grades for respective different applications, and it is possible to suitably change the grade of each of abrasive segments 10 which have been prepared in the same manner to have the same grade.

Experiments were conducted to clarify a relationship between the grinding performance of the grinding wheel 18 using the abrasive segments 10 and the volumetric percentage of the pores of the vitrified abrasive structure filled with the cured resin.

EXAMPLES

The inner core portion 12 of the grinding wheel 18 manufactured in this experiment is a steel disk having the center mounting hole 19, while the radially outer and inner layers 14, 16 of each of the abrasive segments 10 of the wheel 18 have the following compositions:

Outer Layer 14

| | |
|---|---|
| CBN grains (Type-I #80/#100 available from GE company) | 50.0 (parts by volume) |
| Vitrified bonding agent | 18.0 (parts by volume) |
| Caking additive | 10.0 (parts by volume) |

Inner Layer 16

| | |
|---|---|
| Silicon carbide grains (#80) | 50.0 (parts by volume) |
| Vitrified bond agent | 18.0 (parts by volume) |
| Caking additive | 10.0 (parts by volume) |

An unfired or green abrasive structure formed of the above-indicated compositions were fired at 900° C. for five hours, to prepare each abrasive segment 10 having a length of 40 mm (as measured in the circumferential direction of the grinding wheel 18), a width of 10.4 mm (corresponding to the thickness or axial dimension of the grinding wheel 18) and a thickness of 7.4 mm. The outer layer 14 had a thickness of 3.8 mm while the inner layer 16 had a thickness of 3.6 mm. In the meantime, five different mixtures Nos. 1–5 as indicated in Table 1 were prepared by mixing the phenol resin (PR-9400 available from Sumitomo Durez Company, Ltd) and the furfuryl alcohol, with proportions thereof as indicated in Table 1 (in which the phenol resin and the furfuryl alcohol are simply referred to as "Resin" and "Diluent", respectively). Each of the mixtures Nos. 1–5 was stirred for three minutes, and then the abrasive segment 10 was impregnated with each of the mixtures Nos. 1–5 according to the method as described above, whereby vitrified grindstones of Examples 1–5 as indicated in Table 2 were obtained.

Table 2 indicates compositions of the vitrified grindstones of Examples 1–5 and Comparative Examples 1 and 2. The vitrified grindstone of Comparative Example 1 was obtained by impregnating the abrasive segment with the phenol resin, in place of the mixture of the phenol resin and the furfuryl alcohol. The vitrified grindstone of Comparative Example 2 corresponded to a conventional vitrified grindstone which is not impregnated with the phenol resin. It is noted that "Filling ratio" in Table 2 represents a percentage of the total volume of the pores or voids which was replaced by the resin, i.e., a percentage of the total volume of the pores which was filled with the resin, as a result of the impregnation of the vitrified abrasive structure with the resin. It is noted that the indicated volume of each component of the compositions is with respect to the total volume of the vitrified grindstone. It is also noted that the volume of the diluent is indicated in parentheses, since the diluent was eliminated and did not remain in the grindstone after the curing of the resin.

TABLE 1

| | Resin (vol. %) | Diluent (vol. %) |
|---|---|---|
| Mixture No.1 | 95.0 | 5.0 |
| Mixture No.2 | 90.0 | 10.0 |
| Mixture No.3 | 70.0 | 30.0 |
| Mixture No.4 | 40.0 | 60.0 |
| Mixture No.5 | 10.0 | 90.0 |

TABLE 2

| | CBN abrasive grains | Inorganic boding agent | Resin | Diluent | Pores | Filling ratio |
|---|---|---|---|---|---|---|
| Comparative Example 1 | 50.0 | 18.0 | 32.0 | 0.0 | 0.0 | 100 |
| Example 1 | 50.0 | 18.0 | 30.4 | (1.6) | 1.6 | 95 |
| Example 2 | 50.0 | 18.0 | 28.8 | (3.2) | 3.2 | 90 |

TABLE 2-continued

| | CBN abrasive grains | Inorganic boding agent | Resin | Diluent | Pores | Filling ratio |
|---|---|---|---|---|---|---|
| Example 3 | 50.0 | 18.0 | 22.4 | (9.6) | 9.6 | 70 |
| Example 4 | 50.0 | 18.0 | 12.8 | (19.2) | 19.2 | 40 |
| Example 5 | 50.0 | 18.0 | 3.2 | (28.8) | 28.8 | 10 |
| Comparative Example 2 | 50.0 | 18.0 | 0.0 | 0.0 | 32.0 | 0 |

Using the vitrified grindstones of Examples 1–5 and Comparative Examples 1 and 2, grinding operations were successively performed on workpieces on a cylindrical grinding machine, in the following conditions:

[Conditions]

Dimensions of grindstone (grinding wheel): 380 mm (outside diameter)×10 mm (thickness)×80 mm (inside diameter) Workpiece: Cylindrical workpiece made of SCM435 having dimensions of 60 mm (outside diameter)×5 mm (width) Type of grinding operation: Plunge grinding to reduce diameter of workpiece from 60 mm to 37 mm, using a grinding fluid (emulsion water-soluble grinding liquid) Peripheral speed of grindstone (grinding wheel): 160 m/sec Grinding efficiency: 70 $mm^3$/mm Results of the grinding operations by the vitrified grindstones of Examples 1–5 and Comparative Examples 1 and 2 are indicated in Table 3, wherein "Surface roughness" means the surface roughness of the tenth workpiece, "Consumed electric power" means the amount of electric power consumed when the tenth workpiece was machined, and "Filling ratio" represents the percentage of the total volume of the pores or voids which was filled with the resin.

TABLE 3

| | Filling ratio | Resistance to dressing | Grinding ratio | Burning on finished surfaced | Surface roughness Rz | Consumed electric power |
|---|---|---|---|---|---|---|
| Comparative Example 1 | 100 | 0.50(kW) | 2300 | NO | 2.5(μm) | 2.0(kW) |
| Example 1 | 95 | 0.38(kW) | 3600 | NO | 2.5(μm) | 1.8(kW) |
| Example 2 | 90 | 0.38(kW) | 3700 | NO | 2.3(μm) | 1.7(kW) |
| Example 3 | 70 | 0.35(kW) | 4000 | NO | 2.3(μm) | 1.6(kW) |
| Example 4 | 40 | 0.34(kW) | 3700 | NO | 2.4(μm) | 1.6(kW) |
| Example 5 | 10 | 0.32(kW) | 3300 | NO | 2.9(μm) | 1.6(kW) |
| Comparative Example 2 | 0 | 0.30(kW) | 1200 | YES | 3.2(μm) | 1.7(kW) |

As is apparent from Table 3, the grinding ratio in the grinding operations with the vitrified grindstones of Examples 1–5 was about 2.7–3.3 times as high as the grinding ratio in the grinding operation with the conventional vitrified grindstone of Comparative Example 2, which was not impregnated with the resin. Further, each of the vitrified grindstones of Examples 1–5 provided the workpiece with an excellent smoothness on the finished surface without burning or glazing on the surface. The resistance to dressing operation of each of the grindstones of Examples 1–5 was larger than the resistance to dressing operation of the grindstone of Comparative Example 2, by an amount of as small as 0.02–0.08 kW. The electric power consumed in the grinding operations with the grindstone of Examples 1–5 was almost equal to that consumed in the grinding operation with the grindstone of Comparative Example 2. As compared with the grindstone of Comparative Example 1 in which 100% of the total volume of the pores or voids was filled with the resin, is the dressing resistance and the consumed electric power of the grindstone of Examples 1–5 were considerably lower than those of the grindstone of Comparative Example 1. The grinding ratio of the grindstones of Examples 1–5 was about 1.4–1.7 times as high as the grinding ratio of the grinding stone of Comparative Example 1. The surface roughness provided by the grindstones of Examples 1–5 was almost equal to that provided by the grindstone of Comparative Example 1. As a whole, the grindstones of Examples 2–4 whose fill ratio was 40–90% gave better results than the grindstones of Comparative Examples 1 and 2, except that the dressing resistance applied to the grindstones of Examples 2–4 was slightly larger than that applied to the conventional grindstone of Comparative Example 2.

The grindstone of Comparative Example 1, in which the filling ratio was excessively large and the abrasive grains were completely surrounded by the resin, had an increased hardness thereof, and required a comparatively large force to be applied to its grinding surface in the dressing operation so as to crack the inorganic bonding agent for removing dull abrasive grains from the grinding surface. The increased hardness and dressing resistance results in a considerably difficult dressing operation of the grindstone of Comparative Example 1, in which a comparatively large amount of stock has to be removed from the grindstone so as to sufficiently roughen the grinding surface of the grindstone; otherwise it would be difficult to restore sharpness of the abrasive grains, making difficult to continue the grinding operation with the grindstone. Such a comparatively large amount of stock to be removed in the dressing operation undesirably reduces the grinding ratio and shortens the service life of the grindstone. After the difficult dressing operation, the grindstone of Comparative Example 1 necessitates an additional operation for removing the resin between the abrasive grains from the grinding surface, by using a so-called "soft" grindstone, so that cutting edges of the abrasive grains are exposed, namely, so that the grinding surface is assuredly roughened. This additional operation is somewhat cumbersome and causes a risk of removals of the abrasive grains whose sharpness has been restored in the dressing operation.

In contrast to such drawbacks of the grindstone of Comparative Example 1, each of the grindstones of Examples 1–5, in which the filling ratio was held in a suitable range and the resin served to reinforce the abrasive structure, did not require a large force to be applied to its grinding force in the dressing operation, in which sharpness of the abrasive grains can be easily restored without having to remove a large amount of stock from the grindstone, thereby advantageously increasing the grinding ratio and lengthening the service life of the grindstone. Further, each of the grindstones of Examples 1–5 does not necessitate the above-described additional operation for removing the resin from the grinding surface, so that the grinding operation can be restarted with the grindstone after the easy dressing operation.

Each of the grindstones of Examples 1–5 did not suffer from large wear thereof and fusion of metal particles in the pores, leading to an effective use of the grindstone which was equipped with the expensive super abrasive grains. On the other hand, the grindstone of Comparative Example 1 whose filling ratio was 100% suffered from fusion of metal particles in the pores, although did not suffer from burning on the surface of the workpiece ground by this grindstone. The grindstone of Comparative Example 2 whose filling ratio was 0%, suffered from considerable fusion of metal particles in the pores and even burning on the ground surface of the workpiece. It is considered that the fusion of metal particles in the grindstone of Comparative Example 1 was caused by an excessive rise of temperature due to substantial absence of the pores in the grinding surface, which pores would have served as chip pockets for accommodating therein the grinding liquid. It is also considered that the considerable fusion of metal particles in the grindstone of Comparative Example 2 was caused by a reduced number of the abrasive grains dedicated for the grinding operation, due to absence of the resin which would have served for holding the abrasive grains and thereby preventing easy removal of the abrasive grains from the grinding surface.

While the presently preferred embodiment of the present invention have been described above with a certain degree of particularity, by reference to the accompanying drawings, it is to be understood that the invention is not limited to the details of the illustrated embodiment, but may be otherwise embodied.

In the above-illustrated embodiment, the phenol resin is used as the thermosetting synthetic resin with which the vitrified abrasive structure is impregnated. However, the phenol resin may be replaced by one- or two-liquid epoxy resin, or even by a thermoplastic synthetic resin such as urethane resin and polyvinyl alcohol. The two-liquid epoxy resin is prepared, for example, by mixing fluid or liquid hardening agent including polyamide resin, into fluid or liquid primary agent of epoxy resin such as bisphenol A.

In the above-illustrated embodiment, the furfuryl alcohol having a high degree of volatility is used as the liquid diluent which serves to dilute the resin. However, the furfuryl alcohol may be replaced by other alcohol solvent (such as ethanol and methanol), water, thinner, or any other liquid which is capable of diluting the resin and does not impede the curing of the resin. The diluent liquid does not necessarily have to be a liquid capable of dissolving the resin, but may be a liquid capable of suspending the resin.

It is preferable that the liquid diluent has a high degree of volatility and does not remain in the abrasive structure. However, the liquid diluent may be a liquid having a low degree of volatility, as long as the liquid does not impede the curing of the resin even if the liquid remains in the abrasive structure. For instance, while the resin filling 10–95% of the total volumes of the pores of the vitrified abrasive structure is being cured, the liquid diluent may remain in the rest of the total volumes of the pores which is not filled with the resin. That is, the liquid diluent may be any kind of liquid, as long as the liquid is capable of being eliminated as a result of volatilization thereof, or capable of contracting so as to be volumetrically reduced, for thereby forming pores or voids in the abrasive structure before the curing of the resin is completed.

In the above-illustrated embodiment, the volumetric ratio of the resin to the mixture (of the resin and the liquid diluent) corresponds to the volumetric ratio of the pores filled with the resin. However, these ratios do not always correspond to each other, for example, due to possible contraction and gasification of the resin and the liquid diluent. Where these ratios do not correspond to each other, it is desirable to determine the volumetric ratio of the resin to the mixture such that the volumetric ratio of the pores filled with the resin ranges from 10–95 vol. %.

While the mixture is prepared by mixing the phenol resin into the furfuryl alcohol in the above-illustrated embodiment, it is possible to use a resin solution in which these components are mixed with suitable proportions thereof.

In the above-illustrated embodiment, the grindstone takes the form of the abrasive segment 10 which consists of the radially outer layer 14 assigned to perform a grinding operation and the radially inner layer 16 backing up the outer layer 14. However, the abrasive segment may consist of a single layer formed of the same composition as used for the outer layer 14. Further, the grindstone may take the form of an elongated horning bar or a super-finishing block.

While the radially outer layer 14 of the abrasive segment 10 includes super abrasive grains such as cubic-crystal boron nitride (CBN) or diamond abrasive grains in the above-illustrated embodiment, the outer layer 14 may include alundum grains (fused alumina abrasive grains), carborundum grains (silicon carbide abrasive grains) or other ordinary abrasive grains, in place of the super abrasive grains.

While the grinding wheel 18 shown in FIG. 2 has a circular array of the abrasive segments 10, the grinding wheel may use a single integral annular abrasive solid mass.

It is to be understood that the invention may be embodied with various other changes, modifications and improvements, which may occur to those skilled in the art, without departing from the spirit and scope of the invention defined in the following claims.

What is claimed is:

1. A vitrified grindstone having a vitrified abrasive structure which has pores and which includes abrasive grains and an inorganic bonding agent that holds said abrasive grains together, wherein 10–95% of a total volume of said pores is filled with a cured resin.

2. A vitrified grindstone according to claim 1, wherein said vitrified abrasive structure further includes an aggregate such that said abrasive grains and said aggregate are held together by said inorganic bonding agent.

3. A vitrified grindstone according to claim 1, wherein 40–90% of the total volume of said pores is filled with said cured resin.

4. A vitrified grindstone according to claim 1, wherein said cured resin consists of at least one thermosetting synthetic resin which is selected from a phenol resin and an epoxy resin.

5. A vitrified grindstone according to claim 1, wherein said abrasive grains consist of diamond abrasive grains.

6. A vitrified grindstone according to claim 1, wherein said abrasive grains consist of CBN abrasive grains.

7. A vitrified grindstone according to claim 1, wherein said abrasive grains in said vitrified abrasive structure have a concentration of 10–230.

8. A vitrified grindstone according to claim 1, wherein said abrasive grains have an average grain size of 20–220 $\mu$m.

9. A vitrified grindstone according to claim 1, wherein said vitrified abrasive structure has a porosity of 20–75% by volume, before said vitrified abrasive structure is impregnated with said resin.

10. A vitrified grindstone according to claim 1, wherein said inorganic bonding agent includes a crystallized glass in which willemite precipitates.

11. A vitrified grindstone according to claim 1, wherein said vitrified abrasive structure includes 15–35% by volume of said inorganic bonding agent.

12. A vitrified grindstone according to claim 1, wherein said vitrified abrasive structure further includes a pore forming agent.

13. A method of manufacturing a vitrified grindstone having a vitrified abrasive structure which includes abrasive grains and an inorganic bonding agent that holds said abrasive grains together, said method comprising:

a step of preparing a mixture of a liquid resin and a liquid diluent which is other than said liquid resin and which dilutes said liquid resin, such that said mixture includes 10–95% by volume of said liquid resin;

a step of impregnating said vitrified abrasive structure with said mixture; and a step of curing said liquid resin contained in said mixture with which said vitrified abrasive structure is impregnated.

14. A method according to claim 13, wherein said liquid diluent consists of a volatile liquid.

* * * * *